US009540974B2

(12) United States Patent
Demaison et al.

(10) Patent No.: US 9,540,974 B2
(45) Date of Patent: Jan. 10, 2017

(54) METHOD AND SYSTEM FOR MONITORING THE LEVEL OF OIL CONTAINED IN A TANK OF AN AIRCRAFT ENGINE

(75) Inventors: Francois Demaison, Nandy (FR); Xavier Flandrois, Cesson (FR); Jean-Remi Masse, Saint Cloud (FR); Gilles Massot, Voisenon (FR); Julien Ricordeau, Paris (FR); Ouadir Hmad, Montereau Fault Yonne (FR)

(73) Assignee: SNECMA, Paris (FR)

( * ) Notice: Subject to any disclaimer, the term of this patent is extended or adjusted under 35 U.S.C. 154(b) by 101 days.

(21) Appl. No.: 13/641,743

(22) PCT Filed: Apr. 14, 2011

(86) PCT No.: PCT/FR2011/050854

§ 371 (c)(1),
(2), (4) Date: Mar. 21, 2013

(87) PCT Pub. No.: WO2011/131892

PCT Pub. Date: Oct. 27, 2011

(65) Prior Publication Data

US 2013/0218399 A1 Aug. 22, 2013

(30) Foreign Application Priority Data

Apr. 19, 2010 (FR) ..... 10 52954

(51) Int. Cl.
*F01M 11/12* (2006.01)
*F01D 25/18* (2006.01)

(52) U.S. Cl.
CPC ..... *F01M 11/12* (2013.01); *F01D 25/18* (2013.01); *F05D 2260/80* (2013.01)

(58) Field of Classification Search
USPC ..... 701/31.4
See application file for complete search history.

(56) References Cited

U.S. PATENT DOCUMENTS 4,006,260 A * 2/1977 Webb ..... A23B 7/02 426/438
4,259,829 A * 4/1981 Strubbe ..... A01D 41/1276 460/1

(Continued)

FOREIGN PATENT DOCUMENTS

DE 41 18 896 12/1992
DE 100 44 916 3/2002

(Continued)

OTHER PUBLICATIONS

International Search Report Issued Aug. 8, 2011 in PCT/FR11/050854 Filed Apr. 14, 2011.

*Primary Examiner* — Jean-Paul C Cass
(74) *Attorney, Agent, or Firm* — Oblon, McClelland, Maier & Neustadt, L.L.P.

(57) ABSTRACT

A method of monitoring oil level in a tank of an aircraft engine, including: for at least two predetermined operating stages of the engine, during at least one mission of the aircraft: obtaining a plurality of measurements of an oil level of the tank, each measurement being associated with an oil temperature and with an engine speed of rotation, and selecting measurements representative of oil level variations and associated with oil temperatures that are close to a reference temperature and with engine speeds of rotation that are close to a reference speed of rotation; aggregating the measurements selected over the operating stages and during the at least one mission of the aircraft; and comparing the aggregated measurements with reference data to identify abnormal oil consumption of the engine.

13 Claims, 4 Drawing Sheets

(56) References Cited

U.S. PATENT DOCUMENTS 4,466,231 A * 8/1984 Rowland-Hill ..... A01F 12/448 460/2
4,875,889 A * 10/1989 Hagerer ..... A01D 75/282 460/1
5,273,134 A 12/1993 Hegemier et al.
5,282,386 A * 2/1994 Niemczyk ..... F16H 57/0447 340/459
5,319,963 A * 6/1994 Benford ..... F16H 59/72 374/141
5,586,033 A * 12/1996 Hall ..... G05B 13/027 460/1
5,614,664 A * 3/1997 Yamagishi ..... F02B 77/08 340/449
5,716,134 A * 2/1998 Wagner ..... F16H 59/72 374/141
5,775,072 A * 7/1998 Herlitzius ..... A01D 41/1276 460/4
5,831,154 A * 11/1998 Guertler ..... F01M 11/12 701/29.5
5,857,162 A * 1/1999 Vukovich ..... F16H 59/72 477/65
5,960,669 A * 10/1999 Ohashi ..... F16H 59/72 374/145
6,076,030 A * 6/2000 Rowe ..... E02F 3/435 172/4.5
6,146,309 A * 11/2000 Nishino ..... F16H 59/72 477/168
6,226,974 B1 * 5/2001 Andrew ..... F02C 9/28 60/772
6,364,602 B1 * 4/2002 Andrew ..... F01D 21/10 415/1
6,468,154 B1 * 10/2002 Eggenhaus ..... A01F 12/448 460/101
6,506,010 B1 * 1/2003 Yeung ..... F04D 27/02 415/1
6,553,300 B2 * 4/2003 Ma ..... A01D 41/127 382/156
6,574,613 B1 * 6/2003 Moreno-Barragan G01N 33/0034 706/16
6,587,772 B2 * 7/2003 Behnke ..... A01D 43/073 460/1
6,632,136 B2 * 10/2003 Anderson ..... A01F 12/448 460/101
6,794,766 B2 * 9/2004 Wickert ..... F01D 15/10 290/52
6,863,604 B2 * 3/2005 Behnke ..... A01D 41/127 460/6
6,865,890 B2 * 3/2005 Walker ..... F02C 3/30 60/39.3
6,869,355 B2 * 3/2005 Bernhardt ..... A01D 41/1273 460/1
6,872,106 B2 * 3/2005 Kanno ..... B63H 21/265 440/2
7,051,534 B2 * 5/2006 Sandberg ..... F01D 25/00 415/119
7,142,971 B2 * 11/2006 Brown ..... G05D 1/0061 244/183
7,343,262 B2 * 3/2008 Baumgarten ..... A01D 41/1276 701/50
7,519,569 B1 * 4/2009 Flynn ..... G06N 5/043 706/45
7,572,180 B2 * 8/2009 Ricketts ..... A01D 75/282 460/101
7,584,663 B2 * 9/2009 Missotten ..... A01D 41/1273 209/599
7,630,808 B2 * 12/2009 Behnke ..... A01D 41/127 56/10.2 F
7,630,809 B2 * 12/2009 Behnke ..... A01D 41/127 56/10.2 R
7,670,218 B2 * 3/2010 Behnke ..... A01D 41/1276 460/4
7,713,115 B2 * 5/2010 Behnke ..... A01D 41/1276 340/684
7,840,317 B2 * 11/2010 Matos ..... B64D 45/0015 244/189
7,930,044 B2 * 4/2011 Attarwala ..... G05B 13/048 700/28
8,019,701 B2 * 9/2011 Sayyar-Rodsari ... G05B 13/042 706/12
8,145,966 B2 * 3/2012 Roblett ..... H04L 12/2697 455/226.1
8,161,718 B2 * 4/2012 Bussmann ..... A01D 41/127 56/10.2 G
8,483,902 B2 * 7/2013 Cornet ..... F01M 1/18 184/6.11
8,616,005 B1 * 12/2013 Cousino, Sr. ..... F02C 1/002 60/772
8,676,453 B2 * 3/2014 Behnke ..... A01D 41/1276 460/101
8,992,838 B1 * 3/2015 Mueller ..... B01D 53/1406 422/129
2006/0114007 A1 * 6/2006 Cho ..... G01N 33/2888 324/698
2006/0123757 A1 * 6/2006 Baumgarten ..... A01D 41/127 56/10.2 R
2007/0156311 A1 * 7/2007 Elcock ..... G07C 5/008 701/31.4
2008/0053217 A1 3/2008 Nishio et al.
2008/0107369 A1 * 5/2008 Fujita ..... F16C 33/34 384/463
2009/0063060 A1 * 3/2009 Sun ..... G01F 23/265 702/52
2009/0126327 A1 * 5/2009 Bussmann ..... A01D 41/127 56/10.2 A
2009/0164056 A1 * 6/2009 Cornet ..... F01M 1/18 701/3
2010/0057222 A1 * 3/2010 Turner ..... G05B 17/02 700/31
2010/0180663 A1 * 7/2010 Sun ..... G01F 23/265 73/1.02
2010/0217474 A1 * 8/2010 Baumgarten ..... A01D 41/127 701/31.4
2011/0108000 A1 * 5/2011 Williams ..... F02M 25/03 123/25 C
2014/0082108 A1 * 3/2014 Naamani ..... H04L 51/04 709/206
2016/0018381 A1 * 1/2016 Potyrailo ..... G01N 27/026 324/633
2016/0187277 A1 * 6/2016 Potyrailo ..... G01N 33/2888 324/633

FOREIGN PATENT DOCUMENTS

| | | |
|---|---|---|
| DE | 100 61 041 | 6/2002 |
| EP | 1 900 912 | 3/2008 |
| EP | 2 072 762 | 6/2009 |

* cited by examiner

METHOD AND SYSTEM FOR MONITORING THE LEVEL OF OIL CONTAINED IN A TANK OF AN AIRCRAFT ENGINE

BACKGROUND OF THE INVENTION

The present invention relates to the general field of aviation.

More particularly it relates to monitoring the oil consumption of an aeroengine in operation, such as a turbine engine, for example.

In order to estimate the oil consumption of an aeroengine, it is known to count the number of cans of oil poured into the tank of the engine during planned maintenance of the engine (e.g. between successive missions). The quantity of oil corresponding to the number of cans poured in on each filling is recorded on a sheet, and a sliding average is calculated over a plurality of fillings so as to obtain an estimate of the mean oil consumption of the engine. The estimate is then compared with a predetermined reference threshold in order to detect abnormal oil consumption by the engine.

That technique is implemented manually by most airlines. In addition, it does not take account of the difference between oil levels in the tank between the beginning and the end of the period over which the mean is calculated, and that can lead to inaccuracies in the estimated oil consumption.

A second technique that airlines use in certain maintenance computers consists in measuring the level of oil contained in the tank before each takeoff and after each landing of the aircraft. The oil levels as measured in that way are then compared in order to estimate oil consumption over the mission of the aircraft.

It can thus be understood that in order to obtain a reliable estimate of the oil consumption of the engine, that technique requires relatively accurate oil level sensors to be used. Furthermore, that technique does not take account of the quantity of oil that is circulating outside the tank, which quantity may vary depending on various parameters (oil viscosity, engine speed, etc.).

OBJECT AND SUMMARY OF THE INVENTION

The present invention proposes an alternative to the above-mentioned techniques that makes it possible to obtain a reliable estimate of oil consumption by an engine.

More precisely, the invention provides a method of monitoring the level of oil contained in a tank of an aeroengine, the method comprising:

- for at least two predetermined operating stages of the engine, during at least one mission of the aircraft:
  - obtaining a plurality of measurements of an oil level of the tank, each measurement being associated with an oil temperature and with an engine speed of rotation; and
  - selecting measurements representative of oil level variations and associated with oil temperatures that are close to a reference temperature and with engine speeds of rotation that are close to a reference speed of rotation;
- aggregating the measurements selected over the operating stages and during said at least one mission of the aircraft; and
- comparing the aggregated measurements with reference data in order to identify abnormal oil consumption of the engine.

Correspondingly, the invention also provides a monitoring system for monitoring the oil level contained in a tank of an aeroengine, the system comprising:

- means that are activated for at least two predetermined operating stages of the engine during at least one mission of the aircraft:
  - to obtain a plurality of measurements of an oil level of the tank, each measurement being associated with an oil temperature and with an engine speed of rotation; and
  - to select measurements representative of oil level variations, which measurements are associated with oil temperatures close to a reference temperature and with engine speeds of rotation that are close to a reference speed of rotation;
- means for aggregating the measurements selected over the operating stages and during said at least one mission of the aircraft; and
- means for comparing the aggregated measurements with reference data in order to identify abnormal oil consumption of the engine.

Thus, the invention takes account of the oil level in the tank in order to estimate the oil consumption of the engine, and this is advantageously performed by working under iso(i.e. equivalent)-conditions in terms of engine speed and of oil temperature (i.e. under conditions that are similar) so as to make the measured oil levels mutually comparable.

By working under iso-conditions in terms of speed of rotation and of temperature, it is ensured that parameters other than the level of oil in the tank and having an influence on the real consumption of oil by the engine (such as for example: the quantity of oil that is outside the oil tank, known as "gulping", or the expansion/contraction of oil), have an impact on oil consumption that is similar. As a result, it is reasonable to omit estimating these parameters in order to obtain a reliable evaluation of oil consumption by the engine: it is possible to estimate the oil consumption of the engine by taking differences between the oil levels (i.e. by comparing the oil levels directly with one another).

Thus, there is no need to have recourse to complex models, such as for example a gulping model or a model of oil retention in enclosures, for the purpose of adjusting the oil levels prior to comparing them with reference data. Measurements aggregated in accordance with the invention are consistent and mutually comparable, and they make it easy to evaluate the oil consumption of the engine.

Furthermore, the invention is based on measurements collected during at least two stages of operation during the mission of the aircraft. Preferably, these stages of operation correspond to a taxiing stage in the meaning of this invention (this taxiing stage covers both a stage of taxiing before takeoff and a stage of taxiing after landing) and a cruising stage during the mission of the aircraft.

As a result, the estimate of engine oil consumption is not limited to only two measurements taken before the aircraft has taken off and after it has landed, but also makes use of oil level measurements taken during other stages of operation of the aircraft, and possibly over a plurality of missions of the aircraft.

This contributes to improving the accuracy with which engine oil consumption is estimated and makes it possible to detect not only abnormal oil consumption that occurs over a short duration, but also abnormal oil consumption that takes place in the long term. The invention can thus be applied to a trend monitoring type technique when monitoring the oil consumption of an engine.

Furthermore, the invention automates oil level monitoring and requires little or no human intervention. This serves to limit inaccuracies.

It should be observed that the invention is particularly advantageous when the sensors used for measuring the level of oil in the tank are sensors having discrete resolution.

In a particular implementation of the invention, when selecting measurements, measurements that are representative of oil level variations that appear over a duration shorter than a predetermined limit duration are excluded.

This eliminates variations in oil levels that are normal, due to particular events during the stage of operation, such as turning or braking the aircraft, which give rise to a one-shot and momentary increase or a decrease in the level of oil in the tank.

In addition, while selecting measurements, it is also possible to exclude measurements of oil level greater than a predetermined limit oil level, or representative of variations in oil level greater than a predetermined limit variation.

As a result, measurements corresponding to oil levels that are aberrant are eliminated, such as for example a measurement that is greater than the maximum capacity of the tank, etc.

In a particular implementation of the invention, measurement aggregation includes detecting at least one filling of the tank between two successive missions of the aircraft.

Account may thus be taken of the oil tank being filled between two successive missions of the aircraft, where this can have an influence on the oil level and can give rise to differences of level that cannot be put down to any anomaly in oil consumption.

In addition, measurement aggregation may also include correcting at least one oil level measurement as a function of a difference that exists between the oil temperature associated with that measurement and the reference temperature.

As a result, it is possible to take account of small differences of temperature that exist between oil levels measured during the various stages of operation that are taken into consideration or measured within a single stage of operation.

This correction makes it possible to relax somewhat the constraints in terms of temperatures being close to the reference temperature. The concept of temperatures "close to the reference temperature" can accommodate temperature offsets that are greater, e.g. up to 40° C.

In a particular implementation, measurement aggregation includes applying a linear regression to the selected measurements.

The regression serves to smooth the curve of the measurements so as to be insensitive to inaccuracies or to differences that may occur for example between missions or between different operating stages.

In addition, it is possible to obtain the mean oil consumption of the engine, as given by the slope of the straight line obtained by performing regression. This is performed over a longer or shorter period (and thus over a greater or smaller number of measurements) depending on the type of consumption tracking that it is desired to perform.

In a particular implementation, the aggregated measurements are compared relative to a predetermined threshold representative of abnormal consumption of oil by the engine.

It is thus possible to detect a one-shot anomaly in oil consumption.

In a variant, measurements are aggregated over a plurality of missions of the aircraft and the aggregated measurements are compared with a reference curve (e.g. a straight line) representative of normal oil consumption for the engine.

It is then possible to detect anomalies that become manifest over the long term, e.g. after several missions of the aircraft.

In a particular implementation, the monitoring method of the invention is such that:

- measurements are obtained and selected during the mission of the aircraft; and
- measurements are aggregated and compared by a device on the ground to which the selected measurements have been sent.

Correspondingly, in this particular implementation, in the monitoring system of the invention:

- the means for obtaining a plurality of measurements and for selecting the measurements representative of oil level variations are on board the aircraft; and
- the means for aggregating the selected measurements and for comparing the aggregated measurements with reference data are incorporated in a device on the ground;

the aircraft further including means for sending the selected measurements to the device on the ground.

This apportionment serves to accelerate the processing of measurements on the ground and to limit the quantity of measurements that are transmitted during a mission by the aircraft.

In other implementations, it is also possible to envisage that the monitoring method and system of the invention present all or some of the above-specified characteristics in combination.

BRIEF DESCRIPTION OF THE DRAWINGS

Other characteristics and advantages of the present invention appear from the following description made with reference to the accompanying drawings that show an embodiment having no limiting character. In the figures.

DETAILED DESCRIPTION OF AN EMBODIMENT

Figure 1:
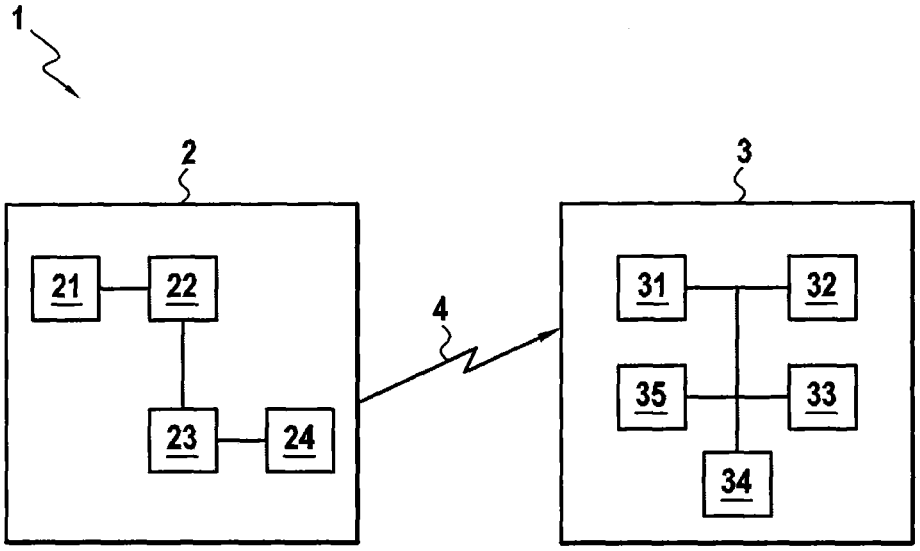
FIG. 1 is a diagrammatic representation of a particular embodiment of a monitoring system in accordance with the invention in its environment.

FIG. 1 shows, in its environment, a system 1 for monitoring the level of oil contained in a tank of an aeroengine in operation (not shown), in accordance with a particular embodiment of the invention.

By way of example, the aeroengine is a turbojet. Nevertheless, it should be observed that the invention applies to other aeroengines, and in particular to other turbine engines, such as a turboprop, etc.

In the embodiment described herein, the means implemented by the monitoring system 1 are shared between two entities, namely the aircraft 2 that is propelled by the engine and a device 3 on the ground, e.g. hosted by the airline operating the aircraft 2.

This assumption is nevertheless not limiting, and it is possible for the monitoring system 1 to be located solely on board the aircraft 2, or to be incorporated entirely in the device 3 on the ground.

In accordance with the invention, the monitoring system 1 is suitable for monitoring the oil level contained in a tank 21 of a turbojet of the aircraft 2.

In known manner, this oil level is measured by a resistive sensor 22 that has discrete resolution. Such a sensor delivers a discrete measurement with resolution that is predefined (e.g. 0.25 quarts (qt) or 0.27 liters (L)). In other words, so long as the oil level measured by the sensor 22 does not change by at least an amount equal to the resolution of the sensor, the discrete measurement delivered by the sensor remains identical. Thus, the absolute measure of the oil level contained in the tank 21 is not known accurately, and whenever the sensor detects a change in oil level, this change is not less than the resolution of the sensor.

Nevertheless, it should be observed that the invention is applicable to other types of oil level sensor, having resolution that may be continuous or discrete.

The aircraft 2 is also fitted with a computer 23 having means for processing the measurements taken by the sensor 22 in accordance with the invention. These means are described below with reference to FIG. 2.

The measurements processed by the computer 23 are sent to the device 3 on the ground by communications means 24 of the aircraft 2. In this example, these means 24 incorporate in particular an airline communications, addressing, and reporting system (ACARS) suitable for communicating using the ARINC standard over a link 4 with the device 3 on the ground. Such means are known to the person skilled in the art and are not described further herein.

The device 3 on the ground in this example presents the hardware architecture of a computer. In particular, it comprises communications means 31 incorporating an ACARS unit suitable for receiving and decoding the messages sent by the aircraft 2, a processor 32, a random access memory (RAM) 33, a read only memory (ROM) 34, and a non-volatile memory 35.

The ROM 34 constitutes a recording medium readable by the processor 32 and having recorded thereon a computer program including instructions for executing certain steps of the monitoring method of the invention as described below with reference to FIG. 3.

Figure 2:
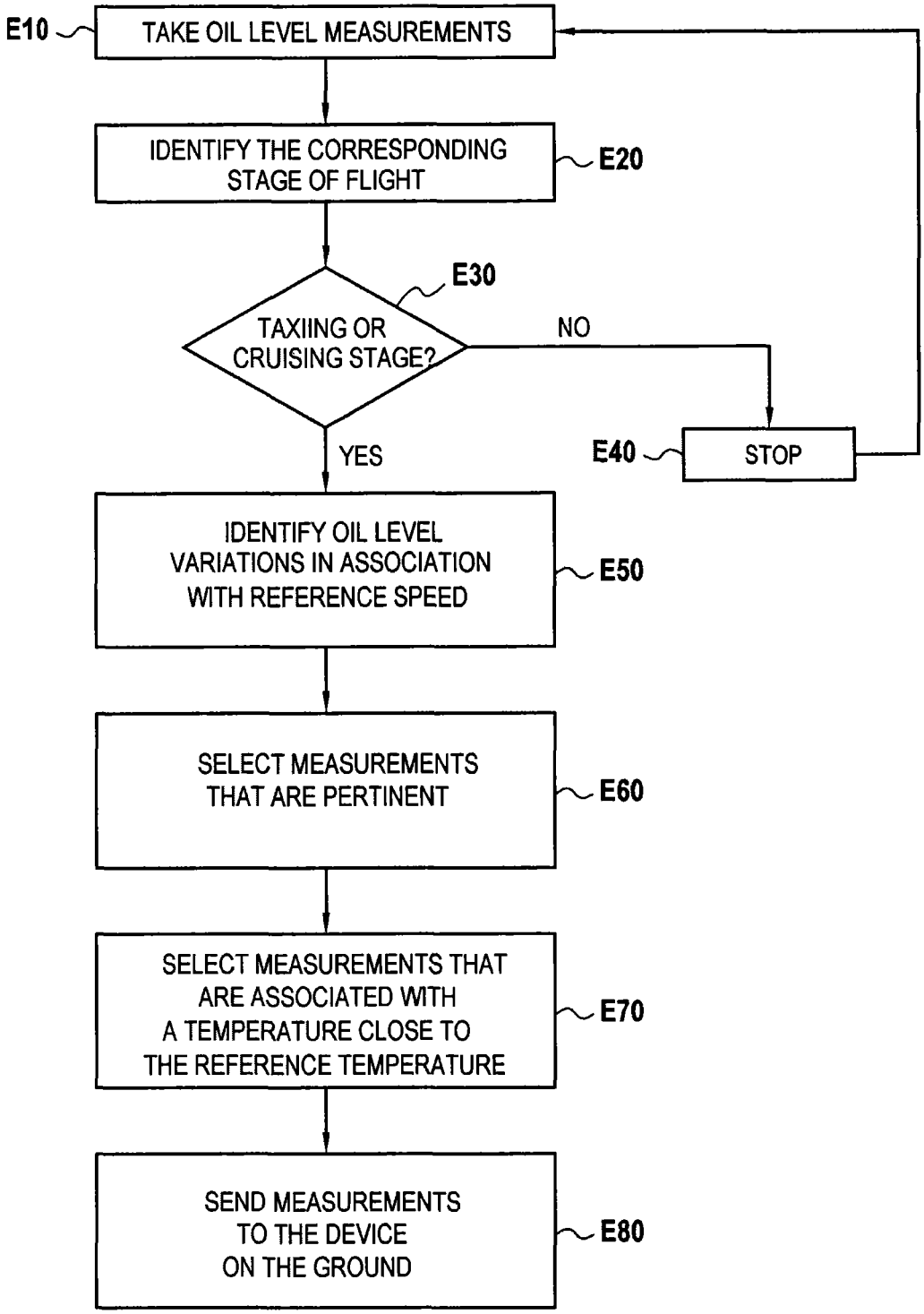
FIGS. 2 and 3 are flow charts showing the main steps of a monitoring method of the invention in a particular implementation in which it is performed by the system shown in FIG. 1.
Figure 3:
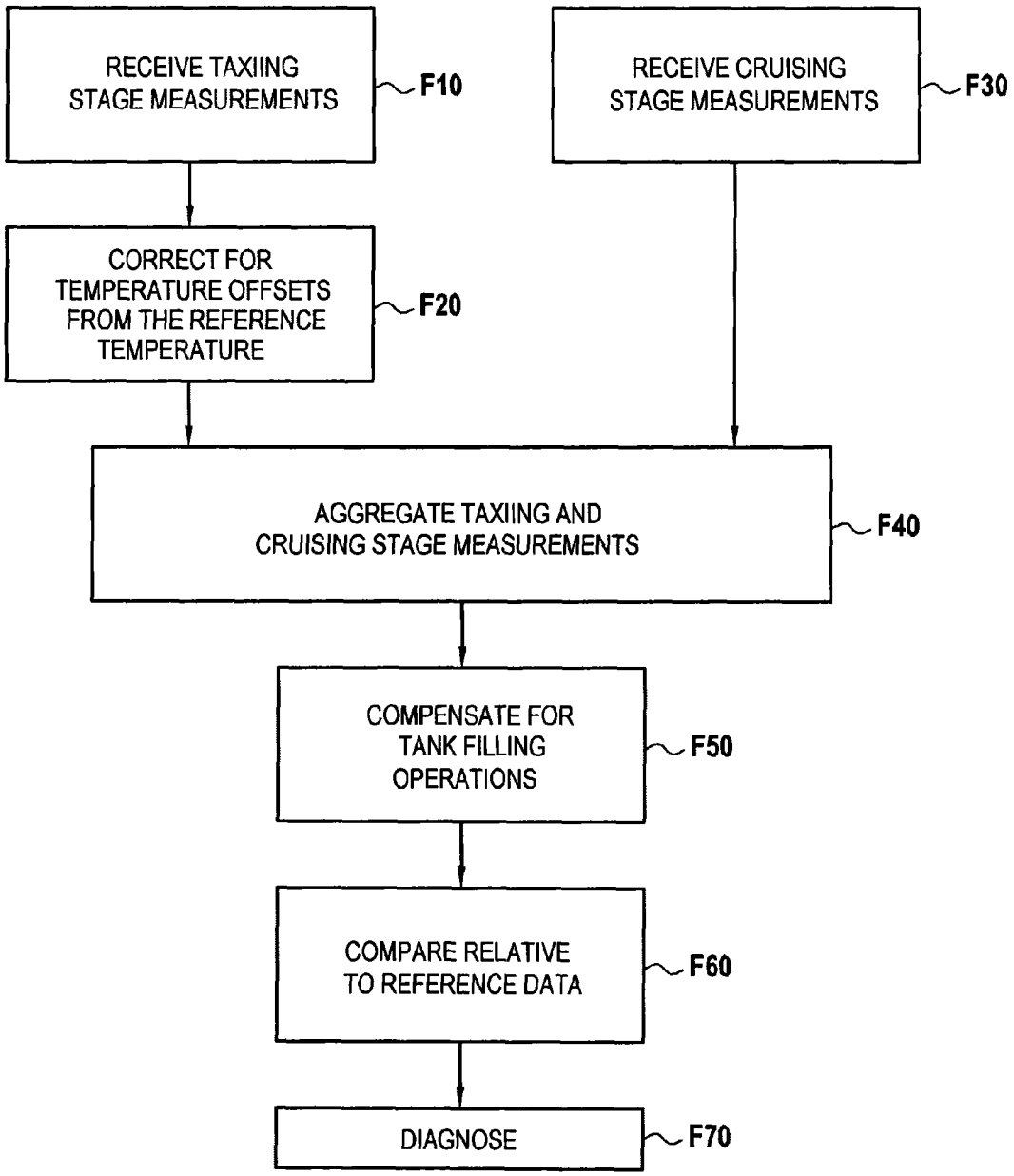

With reference to FIGS. 2 and 3 there follows a description of the main steps of the monitoring method of the invention in a particular implementation in which the steps are implemented by the system 1 shown in FIG. 1 for monitoring the oil level contained in the tank 21 of the turbojet of the aircraft 2.

As mentioned above, in the implementation described herein, certain steps of the monitoring method are implemented on board the aircraft 2, while other steps are implemented by the device 3 on the ground.

The steps implemented on board the aircraft 2 correspond specifically to acquiring measurements of the oil level contained in the tank 21 and extracting appropriate measurements to be able to track the oil consumption of the turbojet. These steps are described with reference to FIG. 2.

The steps implemented by the device 3 on the ground are described below with reference to FIG. 3.

With reference to FIG. 2, during a mission of the aircraft 2, the sensor 22 periodically takes measurements of the level of the oil contained in the tank 21 of the turbojet (step E10).

These measurements are stored in a memory of the computer 23 (not shown) in association both with the temperature of the oil at the time of measurement (temperature measured by a known temperature sensor), and also with the speed of rotation of the turbojet. In this example, the speed of rotation of the turbojet is represented by a parameter N2 that specifies the speed of rotation of the high-pressure compressor shaft of the turbojet.

In a variant, the speed of rotation could be represented by other operating parameters of the turbojet, for example by the parameter N1 that specifies the speed of rotation of the low-pressure compressor shaft of the turbojet.

In the presently-described example, since the sensor 22 is a discrete sensor, it should be observed that the measurement it delivers may remain the same for a long period (e.g. 1 hour (h)) if the factors that influence the level of oil in the tank do not vary. The term "segment" is used herein to designate a set of consecutive measurements that are identical, as delivered by the sensor 22. Thus, in order to limit the amount of memory needed for storing the measurements delivered by the sensor, it suffices, for each segment, to store the value of the oil level measured by the sensor 22 for that segment, the beginning of the segment and its duration, the minimum and maximum oil temperatures reached during that segment, and the corresponding speeds of rotation.

In a variant, all of the measurements taken by the sensor 22 may be stored.

In parallel with acquiring measurements of oil level, of speed of rotation, and of oil temperature, pertinent measurements are extracted in accordance with the invention. This extraction is performed progressively during the mission of the aircraft, firstly in order to optimize the time required for processing the measurements, and secondly for limiting the quantity of measurements stored.

This extraction consists in filtering the measurements so as to select only pertinent measurements that make it possible to evaluate the oil consumption of the turbojet and to detect consumption that is abnormal.

For this purpose, it is also advantageous to limit the quantity of data that is sent to the device 3 on the ground via the ACARS link 4.

The processing for extracting pertinent measurements may differ as a function of the stage of flight during which the measurements are taken, beginning with a step of identifying the flight stage applicable to the aircraft (e.g. engine stopped, starting, taxiing before takeoff, takeoff, climbing, cruising, descending, taxiing after landing, stopping the engine, etc.) (step E20).

Flight stages may be identified as a function of the speed of rotation of the turbojet, and in particular as a function of the above-mentioned parameters N1 and/or N2, and also as a function of the preceding flight stage. Furthermore, a timed state machine may be used for tracking an engine speed characteristic.

In the implementation described herein, only those oil level measurements that are taken during a taxiing stage (before takeoff and after landing) or during a cruising stage are used for estimating the oil consumption of the turbojet (step E30).

The other measurements are not considered as being pertinent (step E40).

The description continues with the processing envisaged for extracting pertinent measurements taken during a taxiing stage. This processing is the result of observations that have been made by the inventors while analyzing raw data collected during real airplane flights.

Thus, it has been observed in particular that while taxiing, the speed of rotation of the turbojet (here represented by the parameter N2) is at about 60% of its maximum speed, and presents higher peaks when the aircraft pilot accelerates. During a peak in the parameter N2, the oil level in the tank 21 drops a little after the acceleration prior to returning to its level prior to acceleration a few seconds after returning to a normal speed of rotation. The measurements taken during a peak in the parameter N2 are therefore not representative of the real oil consumption of the turbojet.

In order to eliminate the oil level measurements corresponding to a stage during which the aircraft is accelerating, a reference speed of rotation for the turbojet is defined, and written N2Ref, which speed corresponds to the speed of rotation most commonly encountered during the mission of the aircraft. For example, N2Ref is taken as being equal to about 60% of the maximum speed of the turbojet.

Then, from among the measurements delivered by the sensor 22, those measurements that are representative of a variation in oil level and that are associated with a parameter N2 close to the reference speed of rotation N2Ref are identified (step E50). This serves to exclude all of the segments that correspond to high peaks of the parameter N2 and that are not pertinent for tracking the oil consumption of the turbojet. This results in working under iso-conditions in terms of turbojet speed of rotation.

Other processing applied to the measurements taken by the sensor 22 while taxiing consists in excluding measurements that are aberrant, i.e. measurements that do not properly-speaking correspond to a physical reality, but that stem from measurement errors (step E60). For this purpose, excluded measurements include in particular oil level measurements greater than a predetermined limit oil level (e.g. the capacity of the tank 21), and measurements that are representative of oil level variations that are greater than a predetermined limit variation (e.g. greater than two or three times the resolution of the sensor, since, while taxiing, variations in oil level are generally equal to the resolution of the sensor).

Finally, during step E60, measurements are also excluded that correspond to segments of a duration that is short, i.e. less than a predetermined limit duration. The purpose of this processing is to exclude oil level variations due to the pilot causing the aircraft to turn or suddenly applying the brakes: such events give rise to an acceleration or a deceleration of the speed of the engine relative to the ground, thereby causing the surface of the oil in the tank to become momentarily inclined.

Thus, at the end of step E60, only those measurements that correspond to oil level variations that are due to temperature changes are conserved.

In order to work under iso-conditions in terms of temperature, measurements are then selected that are associated with an oil temperature close to a predetermined reference temperature TRef (step E70).

It is preferable to select as the reference temperature TRef a temperature that is usually reached by the oil contained in the tank 21, e.g. 100° C.

Various criteria may be applied to estimate whether an oil temperature is "close to" the reference temperature TRef. For example, it may be ensured that the temperature associated with the measurement lies within a range [TRef−α; TRef+β] that is defined around the reference temperature TRef, where α and β designate positive or zero real numbers that depend in particular on the temperature TRef (TRef=100° C. and α=β=4° C.).

It should be observed that it is possible to envisage using values for α and β that are greater, providing an oil level correction is implemented as described in detail below, which correction is performed in the processing by the device 3 on the ground.

In the presently-described example in which the segments corresponding to identical oil level measurements are stored, it is preferable during the step E70 to select segments for which the associated minimum and maximum temperatures lie on either side of the reference temperature. In a variant, it is also possible to select segments in which the minimum and maximum temperatures are relatively close to the reference temperature, i.e. within a predetermined positive or negative offset of the order of a few degrees Celsius.

Naturally, other processing seeking to reduce the number of measurements sent to the device 3 on the ground could be envisaged: a compromise needs to be considered between the pertinence of the measurements sent, the number of measurements needed for reliably estimating oil consumption, and the quantity of information that is transmitted to the device 3 on the ground.

The oil level measurements selected in step E70 are then transmitted to the communications means 31 of the device 3 on the ground by the communications means 24 of the aircraft 2, via the ACARS link 4 (step E80).

For this purpose, the oil level measurements (i.e. in this example the selected segments) are encoded, e.g. as messages complying with the ARINC standard, as known to the person skilled in the art. Each measurement is associated in the message with a corresponding oil temperature and with the stage of flight during which it was taken (in this example a taxiing stage or a cruising stage). In a variant, standards other than the ARINC standard could be used for coding the messages.

In the presently-described implementation, it is envisaged using processing for extracting pertinent measurements taken during a cruising stage that are similar to the processing envisaged for use during a taxiing stage: thus, steps E50 to E80 are also performed for the measurements delivered by the sensor 22 during a cruising stage. Nevertheless, it should be observed that since a cruising stage is a stage that is relatively stable in terms of turbojet speed of rotation, such processing amounts essentially to excluding measurements that correspond to short-duration variations and to selecting measurements associated with temperatures close to the reference temperature.

In a variant, it is possible to envisage other processing that is specific to the cruising stage, e.g. obtaining statistical characteristics (e.g. mean, standard deviation, minimum and maximum values) of the speed of rotation for each segment, or correcting the oil level as a function of the temperature relative to the reference temperature.

Steps E10 to E80 are repeated during each mission of the aircraft.

There follows a description with reference to FIG. 3 of the steps of the monitoring method as implemented by the device 3 on the ground.

As mentioned above, these steps consist essentially in aggregating the measurements sent by the aircraft 2 during one or more missions, and in determining the oil consumption of the turbojet as a function of the measurements as aggregated in this way, in particular in order to detect consumption that is abnormal.

The term "aggregate" is used herein to mean combining the measurements in such a manner as to form a single coherent set of points (e.g. a curve) that is representative of the real variation in the oil level of the tank during missions.

Thus, the measurements obtained in a mission during stages of taxiing before takeoff and after landing, and measurements taken during the cruising stage are ordered chronologically.

In contrast, the way in which the measurements obtained on distinct missions of the aircraft are aggregated may differ as a function of the type of tracking that is desired (e.g. averaged over several flights, or daily, weekly, monthly, etc.). Thus, aggregation may consist in particular in averaging the measurements taken during one mission in order to obtain an average oil level for that mission, or in putting the measurements obtained during different missions into chronological order in order to evaluate variation in the oil level during several successive missions of the aircraft.

In the implementation described herein, it is desired to evaluate oil level variation over several successive missions of the aircraft. The number of missions that are aggregated for tracking purposes varies as a function of the expected nature of the tracking, i.e. whether it is daily, weekly, monthly, etc. tracking. The greater the number of missions taken into consideration, the better the accuracy of the diagnosis that results from analyzing oil level variation, in particular making it possible to identify slow phenomena that lead to the engine having abnormal oil consumption. In contrast, tracking performed over a small number of missions serves to detect phenomena that are rapid.

In order to aggregate measurements from a plurality of missions of the aircraft, the procedure takes place in two stages:

for each mission, aggregating the measurements selected during taxiing stages (before takeoff and after landing) and during the cruising stage, as received by the communications means 31 of the device 3 on the ground (steps F10 and F30); and aggregating over a plurality of missions.

More precisely, for each mission of the aircraft, after receiving the measurements selected for the taxiing stage (step F10), it is initially determined whether any of the measurements need to be corrected because of a difference between the oil temperatures associated with the measurements and the reference temperature (step F20).

As mentioned above, during step E70 offsets of greater or smaller size relative to the reference temperature TRef may be accepted. In particular, it is possible to envisage large offsets (e.g. of the order of 30° C.) when none of the temperatures associated with the measurements taken by the sensor 22 is equal or nearly equal to the reference temperature.

The temperature offset that is acceptable is naturally predefined and depends on the correction that can be performed by the device 3 on the ground. In this example, this correction is performed on the basis of a model that is simple and empirically determined, associating an offset ΔT of the temperature from the reference temperature TRef with an oil level offset ΔQ. For example:

$$\Delta Q = 0.0341417 \times \Delta T$$

Naturally, other models could be envisaged.

The device 3 on the ground corrects the measurements in question by adding thereto an offset ΔQ that is determined using the model, as a function of the temperature offset ΔT that the measurements present relative to the reference temperature.

After performing this correction, the device 3 on the ground acts for the mission in question to put the selected measurements (possibly after correction) concerning taxiing stages and the selected measurements concerning the cruising stage into chronological order (step F40). This produces the variation in oil level in the tank 21 for each mission of the aircraft.

In a variant implementation, a linear regression is also applied to the measurements as ordered in this way in order to smooth the resulting curve.

The measurements in chronological order for each mission are then aggregated for a plurality of missions of the aircraft (step F40), i.e. in this example they are classified in the order of successive missions of the aircraft.

Depending on the number of missions taken into consideration when aggregating measurements, the resulting curve may present "step changes", i.e. sudden variations in oil level between two successive missions of the aircraft. These step changes correspond essentially to the tank 21 being filled between two successive missions of the aircraft.

In order to enable the oil consumption of the engine to be properly analyzed, the device 3 on the ground detects the occasions on which the tank 21 was filled (step F50). For this purpose, it compares oil level variations that occur at the junctions between two successive missions of the aircraft with a predetermined threshold in order to detect the sudden variations.

In addition, in this example, the device 3 on the ground compensates for such filling operations so as to eliminate their influence on the variation of oil level. This compensation is performed by subtracting the quantity of oil that was added when filling the tank. This serves to "align" the measurements aggregated over the various stages and the various missions of the aircraft.

At the end of this compensation, a set C of aggregated measurements is obtained that represent variation in oil level (ignoring refilling the tank) covering a plurality of successive missions of the aircraft. An example of such a set is shown as a series of points in FIG. 4 (set of points C).

A linear regression applied to the points in the set C gives the mean oil consumption of the turbojet over the missions under consideration. This mean consumption is given by the slope of the straight line CRef obtained by the linear regression (shown in FIG. 4). The residuals of the regression and the number of points make it possible to determine the quality of the consumption value estimated in this way.

This mean consumption may then be compared with one or more reference thresholds, e.g. corresponding respectively to a minimum oil consumption and a maximum oil consumption that are acceptable for the engine. Such thresholds are provided by the engine manufacturer.

In the presently-described example, the set of points C is also compared with the straight line CRef (step F60). This comparison serves to detect a discontinuity in the alignment of the points in the set C relative to the mean consumption of the engine, where such a discontinuity is often symptomatic of an anomaly in oil consumption.

The straight line CRef constitutes a reference curve in the meaning of the invention that is representative of normal variation in the oil consumption of the engine. Generally speaking, the oil consumption of an engine varies little. Thus, an offset from the straight line CRef makes it possible to diagnose abnormal consumption of oil by the engine (step F70).

Figure 4:
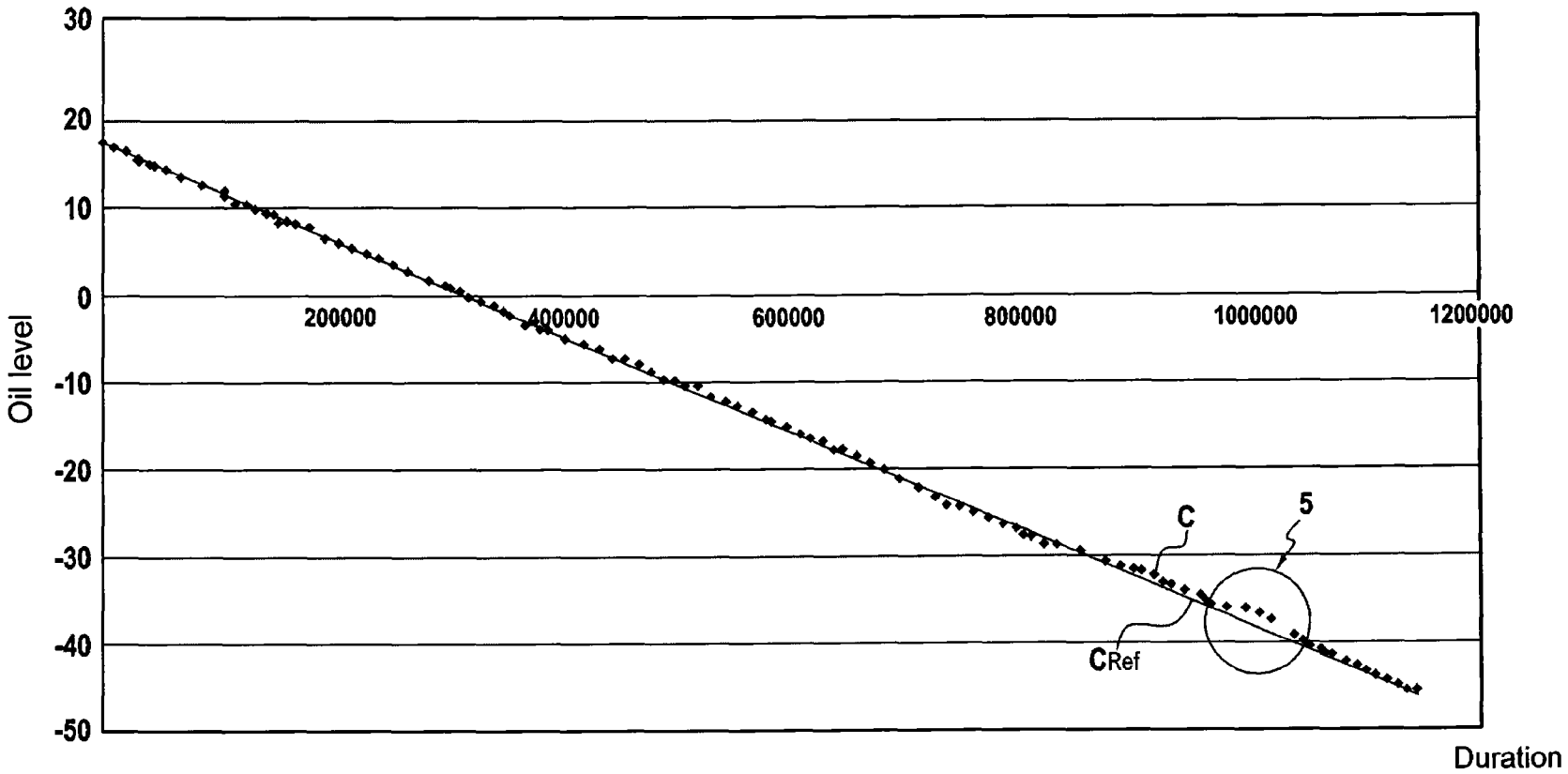
FIG. 4 shows an example of monitoring the oil level in according with the invention by making a comparison with a reference straight line.

By way of example, the step change 5 shown in FIG. 4 is identified in the invention as being representative of consumption that is abnormal. More thorough investigation may be used to determine whether this is a real anomaly in oil consumption by the engine or a faulty measurement, if the offset from the reference curve is not confirmed over time.

In a variant, other reference data may be compared with the curve of the aggregated measurements depending on the types of anomaly that is it desired to detect. For example, the straight line CRef obtained by linear regression on the points of the set C may be compared with a straight line obtained by linear regression on measurements aggregated during past missions. A discontinuity in the slope of those straight lines is then symptomatic of an anomaly in oil consumption.

Furthermore, in the implementation described herein, aggregating measurements over several missions of the aircraft consist in classifying the selected measurements for various missions in chronological order.

In a variant, tracking may consist in evaluating the mean level of oil in the tank 21 (the mean being taken over several missions of the aircraft). A linear regression may then be applied to the aggregated measurements in order to estimate oil consumption by the engine over a mission. The residuals of the regression and the number of points can be used to determine the quality of the consumption value as obtained in this way.

In another variant, it is possible to compare the mean oil level over a mission with reference thresholds representative of a normal oil level in the tank 21, etc.

It is also possible advantageously to improve the diagnosis by comparing consumption tracking over a plurality of engines on a given aircraft. Thus, by way of example, if all of the engines show a variation in consumption of the same order of magnitude, that will be put down to flight conditions, whereas if variation is observed on only one engine that will be considered as being symptomatic of an anomaly in its oil consumption.

Furthermore, in the implementation described herein, an abnormal consumption of oil is detected by comparing the variation of oil level over several successive missions of the aircraft with a reference curve. In a variant, it is possible to estimate oil consumption by taking the difference between two successive aggregated measurements of oil level measurements in order to compare the oil consumption directly with a reference oil consumption.

The invention claimed is:

1. A method of monitoring a level of oil contained in a tank of an aircraft engine, the method comprising:

for at least two predetermined operating stages of the engine, during at least one mission of the aircraft:

measuring, by an oil level sensor, a plurality of measurements of an oil level of the tank, measuring an oil temperature and an engine speed of rotation associated with each measurement of the oil level of the tank, storing, in a memory of a first computer, the measurements of the oil level of the tank and the associated oil temperature and associated engine speed of rotation, and selecting, using the first computer, measurements representative of oil level variations having both oil temperatures that are within a predetermined range of a reference temperature and engine speeds of rotation that are within a predetermined range of a reference speed of rotation corresponding to an iso-condition;

aggregating, using a second computer, only the measurements corresponding to the iso-condition selected over the operating stages during the at least one mission of the aircraft to produce a curve of the oil level of the tank; and comparing, using the second computer, the curve produced by the aggregated measurements with reference data to identify abnormal oil consumption of the engine.

2. A monitoring method according to claim 1, wherein the two predetermined operating stages of the engine correspond to a taxiing stage and to a cruising stage in the mission of the aircraft.

3. A monitoring method according to claim 1, wherein, when selecting measurements, measurements that are representative of oil level variations that appear over a duration shorter than a predetermined limit duration are excluded.

4. A monitoring method according to claim 1, wherein, when selecting measurements, oil level measurements greater than a predetermined limit oil level are excluded.

5. A monitoring method according to claim 1, wherein, when selecting measurements, measurements representative of oil level variations greater than a predetermined limit variation are excluded.

6. A monitoring method according to claim 1, wherein the aggregating the measurements includes detecting at least one filling of the tank between two successive missions of the aircraft.

7. A monitoring method according to claim 1, wherein the aggregating the measurements includes correcting at least one oil level measurement as a function of a difference that exists between the oil temperature associated with the measurement and the reference temperature.

8. A monitoring method according to claim 1, wherein the aggregating the measurements includes applying linear regression to the measurements.

9. A monitoring method according to claim 1, wherein the aggregated measurements are compared relative to a predetermined threshold representative of abnormal consumption of oil by the engine.

10. A monitoring method according to claim 1, wherein measurements are aggregated over a plurality of missions of the aircraft, and the aggregated measurements are compared with a reference curve representative of normal consumption of oil by the engine.

11. A monitoring method according to claim 1, wherein:

measurements are obtained and selected during the mission of the aircraft; and measurements are aggregated and compared by a device on the ground to which the selected measurements have been sent.

12. A monitoring system for monitoring the oil level contained in a tank of an aeroengine, the system comprising:

means that are activated for at least two predetermined operating stages of the engine during at least one mission of the aircraft:

for measuring a plurality of measurements of an oil level of the tank, for measuring an oil temperature and an engine speed of rotation associated with each measurement of the oil level of the tank, and for selecting measurements representative of oil level variations having both oil temperatures within a predetermined range of a reference temperature and engine speeds of rotation that are within a predetermined range of a reference speed of rotation corresponding to an iso-condition:

means for aggregating only the measurements corresponding to the iso-condition selected over the operating stages during the at least one mission of the aircraft to produce a curve of the oil level of the tank; and means for comparing the curve produced by the aggregated measurements with reference data in order to identify abnormal oil consumption of the engine.

13. A monitoring system according to claim 12, wherein:

the means for obtaining a plurality of measurements and for selecting the measurements representative of oil level variations are on board the aircraft; and the means for aggregating the selected measurements and for comparing the aggregated measurements with reference data are incorporated in a device on the ground;

the aircraft further including means for sending the selected measurements to the device on the ground.

* * * * *